US006016029A

United States Patent [19]

Okayama et al.

[11] Patent Number: 6,016,029

[45] Date of Patent: Jan. 18, 2000

[54] RAW MATERIAL FOR MAGNETIC SHIELD, PRODUCTION METHOD THEREOF, AND COLOR TELEVISION RECEIVER

[75] Inventors: Hironao Okayama; Akira Ikeda, both of Yamaguchi, Japan

[73] Assignee: Toyo Kohan Co., Ltd., Tokyo, Japan

[21] Appl. No.: 09/000,377

[22] PCT Filed: Aug. 6, 1996

[86] PCT No.: PCT/JP96/02217

§ 371 Date: Feb. 6, 1998

§ 102(e) Date: Feb. 6, 1998

[87] PCT Pub. No.: WO97/06285

PCT Pub. Date: Feb. 20, 1997

[30] Foreign Application Priority Data

Aug. 7, 1995 [JP] Japan ..... 7-219478

[51] Int. Cl.[7] ..... H01J 29/80

[52] U.S. Cl. ..... 313/402; 148/120; 148/306; 148/332; 148/651

[58] Field of Search ..... 148/306, 120, 148/332, 651; 420/89; 313/402

[56] References Cited

U.S. PATENT DOCUMENTS

| | | | |
|---|---|---|---|
| 3,620,856 | 11/1971 | Hiraoka et al. | 148/306 |
| 4,961,793 | 10/1990 | Kishida et al.AL. | 148/332 |
| 5,803,988 | 9/1998 | Bae et al. | 148/120 |

FOREIGN PATENT DOCUMENTS

| | | | |
|---|---|---|---|
| 3841870 | 1/1990 | Germany . | |
| 59-19619 | 5/1984 | Japan . | |
| 1-142028 | 11/1987 | Japan | 148/120 |
| 1-51537 | 11/1989 | Japan . | |
| 2-170921 | 7/1990 | Japan . | |
| 3-66369 | 10/1991 | Japan . | |
| 5-64698 | 9/1993 | Japan . | |

OTHER PUBLICATIONS

Rickett and Leslie, "Recrystallization, Structure, and Hardness of Low Carbon Steels Containing Up to 1 % Copper," Fortieth Annual Convention of the American Society for Metals, Cleveland, Ohio, Oct. 27, 1958 to Dec. 31, 1958, pp. 1–24.

*Primary Examiner*—John Sheehan
*Assistant Examiner*—Andrew L. Oltmans
*Attorney, Agent, or Firm*—Browdy and Neimark

[57] ABSTRACT

Magnetic shield materials having excellent inner magnetic shield characteristics and an excellent handling strength, method for producing thereof and color picture tubes produced by incorporating the materials are provided. The magnetic shield materials are produced by subjecting hot rolled low carbon steel strips essentially consisting of equal to or less than 0.006 weight % of C, equal to or less than 0.002 weight % of N, equal to or less than 0.5 weight % of Mn, 0.1–1.5 weight % of Cu, Fe as a balance and unavoidable impurities to a cold rolling and subsequently annealing the cold rolled steel strips at a temperature of 550–850° C.

5 Claims, No Drawings

RAW MATERIAL FOR MAGNETIC SHIELD, PRODUCTION METHOD THEREOF, AND COLOR TELEVISION RECEIVER

FIELD OF ART

The present invention relates to magnetic shield materials used in color picture tubes, a method for producing the materials and color picture tubes incorporating the materials, and more particularly, magnetic shield materials employed in color picture tubes, a method for producing the materials and color picture tubes incorporating the materials which show an improved strength in handling.

BACKGROUND

A color picture tube such as a picture tube employed in a color television set substantially comprises an electron gun and a fluorescent surface which converts electron beams into an image. The inside of the picture tube is covered with magnetic shield materials for preventing electron beams from being deflected by a terrestrial magnetism.

As such magnetic shield materials, thin steel sheets on which a black treatment or a nickel plating is provided are used, wherein the thin steel sheets are formed in a desired shape by bending and sealed to a Braun tube at a temperature around 600° C. The steel sheets used as the magnetic shield materials are required to meet favorable mechanical characteristics such as a favorable formability including bending and a handling strength capable of preventing the deformation of workpieces at the time of conveying the magnetic shield materials before or after forming operation as well as at the time of piling the workpieces, in addition to excellent magnetic shield properties such as high permeability and low coercive force.

To decrease the coercive force while increasing the permeability, the presence of precipitation such as carbon, nitrogen, carbide or nitride in the steels which impedes the movement of ferromagnetic domain wall must be minimized and the grain growth must be promoted while decreasing grain boundary. Decreasing of carbon and nitrogen in the steels while increasing the grain growth of the steels provides an improvement of formability such as bending since the strength of the steels is lowered. However, at the time of conveying the steel sheets or workpieces which are produced by bending, they tend to suffer from irregularities even when a slight impact is applied to them or the workpieces tend to be deformed due to the weight of the workpieces piled. Although the handling strength of the steel sheets can be enhanced by grain refining or by an addition of a certain amount of carbon and nitrogen into the steels so as to precipitate carbide and nitride in the steels, such a method causes deterioration of magnetic characteristics. In this manner, the steel sheets used as the magnetic shield materials must simultaneously meet the excellent magnetic characteristics and the favorable handling strength which conflict with each other.

Accordingly, it is an object of the present invention to provide magnetic shield materials used in color picture tubes which has excellent inner magnetic shield characteristics and an excellent handling strength and color picture tubes incorporating such magnetic shield materials.

DISCLOSURE OF INVENTION

The magnetic shield materials used in color picture tubes according to the present invention are produced by subjecting hot rolled low carbon steel strips essentially consisting of equal to or less than 0.006 weight % of C, equal to or less than 0.002 weight % of N, equal to or less than 0.5 weight % of Mn, 0.1–1.5% weight of Cu, Fe as a balance and unavoidable impurities to a cold rolling and annealing the cold rolled steel strips at a temperature of 550–850° C.

According to the present invention, by adding Cu to hyper-low carbon steels, carbon is held in a solid solution or finely precipitated so that the tensile strength of the hyper-low carbon steels can be held equal to or more than 40 $kg/mm^2$ while the coercive force is held equal to or less than 1.2 oersted whereby the magnetic shield materials used in color picture tubes having excellent magnetic characteristics and an excellent handling strength at the same time can be obtained.

BEST MODE FOR CARRYING OUT INVENTION

The present invention is described in detail hereinafter in view of a following embodiment.

As hyper-low carbon steels which can be used as the magnetic shield materials used in color picture tubes according to the present invention, hyper-low carbon steels which are produced by subjecting the steels to decarburization and denitrization by a vacuum degassing so as to decrease carbide and nitride in the steels and subsequently subjecting the steels to a hot rolling and a continuous annealing is preferable. Furthermore, since carbide and nitride which are finely dispersed in the steels prevent the movement of a ferromagnetic domain wall and thus deteriorate the magnetic characteristics, elements which are to be included in the steels must be preliminarily restricted in number and the amount of these elements must be restricted as small as possible. Firstly, the reason for restricting the number of elements included in the steels and the amount of these elements is explained.

As for C, in case where an amount of C in the cold rolled steel sheets is rich, carbide is increased so that the movement of the ferromagnetic domain wall is hindered while the grain growth is also hampered. Thus, it becomes difficult to lower the coercive force of the steels. Accordlingly, the upper limit of the amount of C should be 0.006 weight %. The lower limit of the amount of C should be as low as possible provided that the vacuum degassing can be effectively carried out.

As for N, in case where aluminium killed steels are used as the magnetic shield materials for the present invention, N reacts with solid-solution state aluminium in the steel to form fine AlN which deteriorates the magnetic characteristics. Accordingly, the amount of N should be equal to or less than 0.002 weight %.

As for Mn, the addition of Mn is necessary since Mn is bound to S in the steel and fixes S in the steel as MnS to prevent the hot shortness. Corresponding to the decrease of amount of Mn, the magnetic characteristics are increased. Accordingly, the amount of Mn should be equal to or less than 0.5 weight %.

As for Cu, provided that a desired heat treating condition is carrrid out, Cu can be added to the steels in a solid-solution state and improves the strength of the steel without deteriorating the magnetic characteristics thereof. Furthermore, the grain size of the fine preciptated of Cu which is produced at the time of annealing is approximately 1–20 nm. In this manner, since the grain size of precipitated Cu is extremely fine, the movement of the ferromagnetic domain wall is not hindered by this finely precipitated Cu contrary to precipitated C or precipitated N. Although with the addition of equal to or more than 0.1 weight % of Cu, the steels can have the handling strength required in the present invention, when the amount of Cu exceeds 1.5 weight %, the magnetic characteristics are deteriorated and hot shortness occurs thus deteriorating workability and formability of the steel. Accordingly, the upper limit of the amount of Cu should be 1.5%.

The production processes of thin steel sheets used as the magnetic shield materials are explained hereinafter.

Firstly, hyper-low carbon hot rolled steel strips having the above-mentioned chemical compositions which are produced by means of vacuum refining or vaccum degassing are subjected to pickling so as to remove an oxide film produced during a hot rolling process. Subsequently, the hot rolled steel strips are cold rolled at a rate of equal to or more than 70% so as to make the thickness of the steel strips 0.15–0.25 mm. In case where the cold rolling rate is less than 70%, when the steel strips are annealed after cold rolling, the tensile strength of the steel strips are less than 40 kg/mm$^2$ so that the handling strength required by the present invention cannot be obtained. Annealing should preferably be carried out at a temperature of 550–850° C. for 3 minutes to 5 hours depending on the required strength. When the annealing temperature is less than 550° C., the coercive force of equal to or less than 1.2 oersted required for the present invention cannot be obtained. Meanwhile, in case where the amount of Cu is decreased so as to improve the strength of the steels by fine precipitation rather than solid solution, the Cu totally solid-dissolves into the steels at the higher annealing temperature so that the tensile strength required for the present invention cannot be obtained. Furthermore, with a sufficient addition amount of Cu, when the annealing is carried out at a temperature which exceeds 850° C., the tensile strength of equal to or more than 40 kg/mm$^2$ cannot be obtained even with a heating period of less than 3 minutes. Preferably, corresponding to the addition amount of Cu, the annealing should be carried out at a temperature of 600–800° C. for 5 minutes–2 hours. Manner of annealing may either be a box annealing or a continuous annealing depending on the heating temperature and heating time.

The present invention is further explained in detail in view of a following example.

EXAMPLE

Three kinds of steels A, B and C respectively having chemical compositions shown in Table 1 were prepared in a form of slabs by a vacuum degassing and then were subjected to a hot rolling to produce hot rolled steel sheets having a thickness of 1.8 mm. These hot rolled steel sheets were pickled in sulfuric acid and then were subjected to a cold rolling to produce cold rolled steel sheets having a thickness of 0.15 mm. The cold rolled steel sheets were subjected to a continuous annealing under conditions shown in Tables 2–4 to produce 11 kinds of samples on respective kinds of steels A, B and C. The coercive force of the annealed samples produced in the way mentioned above was measured in such a manner that a first and a second coil were wound around the annealed samples and a magnetic field of 10 oersted was applied to the samples. The tensile strength of annealed samples were measured by TENSILON.

Measured results were shown in Tables 2–4. It is understood that the magnetic shield materials according to the present invention has the lower coercive force and (at the same time) the higher tensile strength so that the materials can preferably be used as the magnetic shield materials used in color picture tubes. On the contrary, the steels of comparative Example A-11, B-11 and C-11 cannot have the sufficient tensile strength.

TABLE 1

(wt %)

| kind of steel | C | N | Mn | Cu | Fe |
|---|---|---|---|---|---|
| A | 0.006 | 0.002 | 0.47 | 0.10 | balance |
| B | 0.005 | 0.002 | 0.39 | 1.05 | balance |
| C | 0.006 | 0.002 | 0.42 | 1.48 | balance |

TABLE 2

| Sample code | annealing condition temperature (° C.) | annealing condition time (min) | coercive force (Oe) | tensile strength (kg/mmN$^2$) | Classification |
|---|---|---|---|---|---|
| | | | | | present invention |
| A - 1 | 550 | 20 | 1.20 | 74 | Example |
| A - 2 | 550 | 30 | 1.18 | 73 | Example |
| A - 3 | 550 | 300 | 1.03 | 41 | Example |
| A - 4 | 600 | 15 | 1.13 | 67 | Example |
| A - 5 | 600 | 20 | 1.08 | 65 | Example |
| A - 6 | 700 | 5 | 1.13 | 59 | Example |
| A - 7 | 700 | 10 | 1.07 | 54 | Example |
| A - 8 | 800 | 5 | 1.01 | 42 | Example |
| A - 9 | 800 | 10 | 0.99 | 40 | Example |
| A - 10 | 850 | 3 | 0.96 | 40 | Example |
| A - 11 | 880 | 3 | 0.90 | 33 | Comparative Example |

TABLE 3

| Sample code | annealing condition temperature (° C.) | annealing condition time (min) | coercive force (Oe) | tensile strength (kg/mm$^2$) | Classification |
|---|---|---|---|---|---|
| | | | | | present invention |
| B - 1 | 550 | 20 | 1.20 | 89 | Example |
| B - 2 | 550 | 30 | 1.19 | 87 | Example |
| B - 3 | 550 | 300 | 1.04 | 48 | Example |
| B - 4 | 600 | 15 | 1.19 | 80 | Example |
| B - 5 | 600 | 20 | 1.19 | 78 | Example |
| B - 6 | 700 | 5 | 1.20 | 74 | Example |
| B - 7 | 700 | 10 | 1.11 | 69 | Example |
| B - 8 | 800 | 5 | 1.07 | 58 | Example |
| B - 9 | 800 | 10 | 1.03 | 41 | Example |
| B - 10 | 850 | 3 | 1.00 | 42 | Example |
| B - 11 | 880 | 3 | 0.97 | 34 | Comparative Example |

TABLE 4

| Sample code | annealing condition temperature (° C.) | annealing condition time (min) | coercive force (Oe) | tensile strength (kg/mm$^2$) | Classification |
|---|---|---|---|---|---|
| | | | | | present invention |
| C - 1 | 550 | 20 | 1.20 | 83 | Example |
| C - 2 | 550 | 30 | 1.20 | 81 | Example |
| C - 3 | 550 | 300 | 1.10 | 43 | Example |
| C - 4 | 600 | 15 | 1.20 | 74 | Example |
| C - 5 | 600 | 20 | 1.20 | 72 | Example |
| C - 6 | 700 | 5 | 1.20 | 67 | Example |
| C - 7 | 700 | 10 | 1.14 | 63 | Example |

TABLE 4-continued

| Sample code | annealing condition temperature (° C.) | time (min) | coercive force (Oe) | tensile strength ($kg/mm^2$) | Classification |
|---|---|---|---|---|---|
| C - 8 | 800 | 5 | 1.02 | 51 | Example |
| C - 9 | 800 | 10 | 1.00 | 43 | Example |
| C - 10 | 850 | 3 | 0.99 | 46 | Example |
| C - 11 | 880 | 3 | 0.97 | 38 | Comparative Example |

INDUSTRIAL APPLICABILITY

The magnetic shield materials according to the present invention has a low coercive force and a high tensile strength so that the materials are preferably be used as the magnetic shield materials used in color picture tubes. The color picture tubes incorporating the materials have an excellent strength and can be readily mounted when they are installed in the tubes.

We claim:

1. A color picture tube incorporating a magnetic shield material having been produced by subjecting a hot rolled low carbon steel strip consisting essentially of equal to or less than 0.006 wt % of C, equal to or less than 0.002 wt % of N, equal to or less than 0.5 wt % of Mn, 0.1–1.5 wt % of Cu, unavoidable impurities and Fe as balance to a cold rolling and subsequent annealing of the cold rolled steel strip at a temperature of 550–850° C.

2. A color picture tube in accordance with claim 1, wherein said magnetic shield material has a tensile strength equal to or greater than 40 $kg/mm^2$ and a coercive force no greater than 1.2 oersted.

3. The color picture tube of claim 1 wherein said magnetic shield material consists of said Cu, said Fe and said unavoidable impurities, and optionally at least one of said C, said N and said Mn.

4. The color picture tube of claim 3 wherein said Mn is present in said magnetic shield material.

5. The color picture tube of claim 1 wherein said magnetic shield material has a thickness 0.15–0.25 mm.

* * * * *